United States Patent [19]

Deike

[11] 3,969,853

[45] July 20, 1976

[54] TORQUE FIN ANCHOR

[75] Inventor: Robert F. Deike, Cheyenne, Wyo.

[73] Assignee: Foresight Industries, Cheyenne, Wyo.

[22] Filed: Feb. 3, 1975

[21] Appl. No.: 546,335

[52] U.S. Cl. ..... 52/156; 52/163; 52/165; 52/167

[51] Int. Cl.[2] ..... E02D 5/80

[58] Field of Search ..... 52/169, 156, 155, 166, 52/98, 167, 298, 163

[56] References Cited

UNITED STATES PATENTS

| | | | |
|---|---|---|---|
| 728,609 | 5/1903 | Pitcher | 52/156 |
| 2,643,843 | 6/1953 | Brown | 52/165 |
| 3,011,597 | 12/1961 | Galloway | 52/156 |
| 3,066,769 | 12/1962 | Pasquale | 52/165 |
| 3,139,163 | 6/1964 | Haller | 52/155 |
| 3,302,347 | 2/1967 | Jackson | 52/155 |
| 3,342,444 | 9/1967 | Nelson | 52/165 |
| 3,628,296 | 12/1971 | Henry | 52/98 |
| 3,653,167 | 4/1972 | Menard | 52/166 |
| 3,676,965 | 7/1972 | Deike | 52/98 |
| 3,840,203 | 10/1974 | Sheehy | 52/298 |

FOREIGN PATENTS OR APPLICATIONS

| | | | |
|---|---|---|---|
| 13,473 | 4/1910 | Denmark | 52/155 |

*Primary Examiner*—Ernest R. Purser
*Assistant Examiner*—Henry Raduazo
*Attorney, Agent, or Firm*—Hill, Gross, Simpson, Van Santen, Steadman, Chiara & Simpson

[57] ABSTRACT

A torque fin ground anchor useful as a cable anchor or post anchor, has angled or tilted fins presenting large surface areas to the ground and radiating from a central pile which is preferably a hollow tube, with the fins preferably flat rectangles having tapered leading edges. When used as a torque fin cable anchor, a cable is attached to one of the fins through a hole located rearward of the mid point of the fin and near a lateral edge of the fin. The cable anchor is driven lengthwise into the ground, the cable is tensioned and the anchor tilted to a transverse underground maximum retention position. When used as a torque fin post anchor, it is also driven lengthwise into the ground, a post is telescoped into the tube portion and locked thereto by a clamp. The post may also be a hollow tube with a hole punched therein adjacent the clamp providing a weakened section, so that in the event of impact as by an automobile, the post will break away from the clamp and is available for re-use by merely loosening the clamp and removing the short post section from the anchor. The surface areas of the fins confront the ground in planes which will resist movement of the anchor under loads to which it is subjected, i.e. vertically for resisting tilting of posts and horizontally for resisting retraction of cables.

3 Claims, 10 Drawing Figures

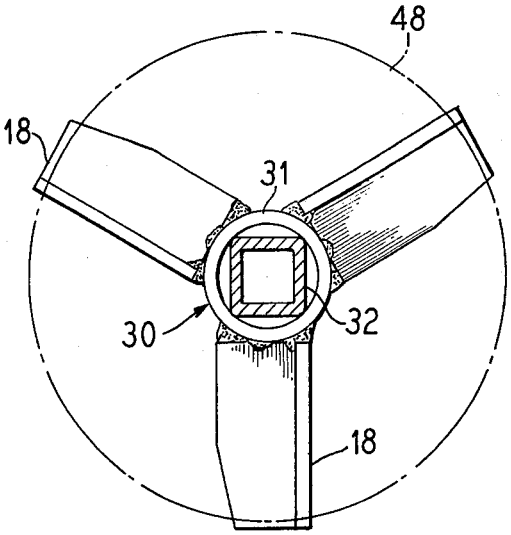
Fig. 6
Fig. 7
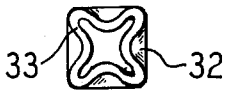
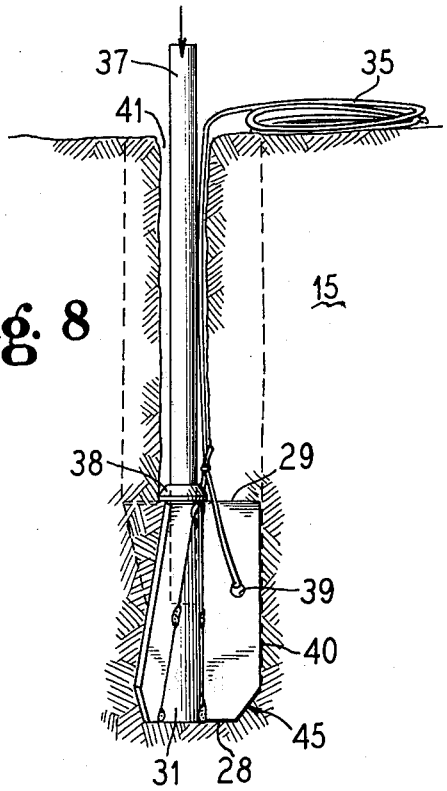
Fig. 8
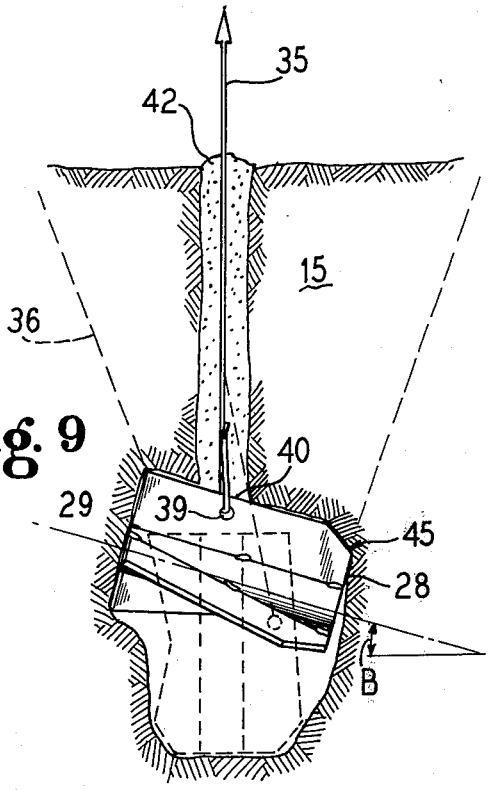
Fig. 9
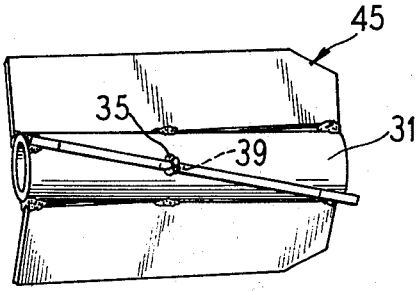
Fig. 10

TORQUE FIN ANCHOR

BACKGROUND OF THE INVENTION

1. Field of the Invention

This invention relates to ground or earth anchors and more particularly to a post or cable anchor having fins.

2. Description of the Prior Art

A load carrying earth anchor having helical vanes and extensible tentacles is disclosed and claimed in my prior U.S. Pat. No. 3,680,274 issued August 1, 1972. This anchor is especially suitable for heavy duty usage but is costly to produce.

SUMMARY OF THE INVENTION

The ground anchors of this invention have a plurality, preferably three, of circumferentially spaced rectangular fins radiating from a central pile or tube and inclined, preferably at an angle of about 15° relative to the pile or tube length. The fins present large surface areas to the ground to prevent shifting of the anchor under load and the tilt angle of the fins arrests retraction of parts carried thereby.

In one embodiment the pile is a tube having a split end with the fins mounted near this end while the other end of the tube is deformed to a star shape providing a drill point facilitating driving of the tube into hard ground. The pointed end of the tube is driven into the ground until the rear edges of the fins are flush with the ground surface. A tubular post is then telescoped in the split end of the anchor tube and a clamp such as a U-bolt contracts the split end of the tube around the post. This embodiment is particularly useful for highway delineators or signs and a hole may be pierced into the side of the post facing oncoming traffic at a level just above the clamp so that when the post is struck by an automobile or the like it will break just above the clamp and can be re-used by merely loosening the clamp, removing the post section from the anchor, inserting the broken end of the post into the anchor tube and tightening the clamp. Alternately, of course, a new post could be used.

In another embodiment of the invention, the central pile of the anchor is a short hollow tube with the fins radiating therefrom as in the first embodiment. The tube is then dropped over a post previously driven in the ground. An impactor, preferably in the form of a cylindrical plate with a hollow stem fits freely around the post and engages the top edges of the anchor fins and tube so as to drive the anchor into the ground, compacting the earth surrounding the anchor and firmly locking the post and anchor in the ground.

In another embodiment of the invention the anchor is driven into the ground to a desired depth or dropped into a pre-drilled hole and a cable attached to one of the fins is then tensioned to tilt the anchor underground causing it to assume a transverse position affording maximum resistance to retraction. A firm cable anchor is thus established.

The anchors of this invention are capable of eliminating the filling of holes with concrete around the post or cable to be anchored, are easily and quickly placed in underground anchoring position, and provide a compaction of the earth which cannot be obtained with concrete filled holes. Further, the anchors of this invention provide more resilient foundations for posts or cables than can be obtained with concrete anchors and the resilient mountings will better resist impact loads without fracture or bending. Of course, considerable savings are effected in labor costs, material costs, and replacement costs.

It is then an object of this invention to provide ground anchors with radiating fins which confront the earth with large face areas in planes producing high torque resistance to shifting of the anchor under load while also compacting the earth.

Another object of the invention is to provide a ground anchor having a hollow tube pile and fins radiating therefrom along the length thereof which are equally circumferentially spaced and are inclined at angles to compact the surrounding earth as they are driven into the ground and present large face areas to the surrounding earth for resisting retraction.

Another object of the invention is to provide a post anchor having a hollow central pile member with a driving point on one end and a split contractible opposite end and having wide face earth confronting fins radiating therefrom whereby the fins will anchor the pile in the ground and the split end is adapted to be contracted by a clamp arcund the post carried by the anchor.

A still further object of the invention is to provide a finned ground anchor which is dropped over a post driven in the ground and then forced into the ground for firmly anchoring the post.

Another object of the invention is to provide a finned anchor which is placed underground and rotated to a tilted position by tension on a cable applied thereto to present wide fin faces to the overlying earth developing high torque resistance against retraction.

A specific object of the invention is to provide an underground anchor composed of a central hollow pile member with inclined fins radiating therefrom in circumferentially spaced relation and having bevelled leading edges.

Other and further objects of this invention will become apparent to those skilled in this art from the following description of several preferred embodiments of this invention shown on the accompanying sheets of drawings.

BRIEF DESCRIPTION OF THE DRAWINGS

FIG. 6 is a transverse sectional view taken along the line VI—VI of FIG. 5 and showing the outline of the overlying impactor.

FIG. 7 is a bottom plan view of the driving end of the anchor of FIG. 5 taken along the line VII—VII of FIG. 5.

FIG. 8 is a side elevational view of the embodiment of a torque fin ground anchor of this invention for use as a cable anchor and illustrating the driving of the anchor into the ground.

FIG. 9 is a side elevational view showing the tilting of the anchor of FIG. 8 to its maximum retension position.

FIG. 10 is a perspective view of the cable anchor of FIGS. 8 and 9.

DESCRIPTION OF THE PREFERRED EMBODIMENTS

Figure 1:
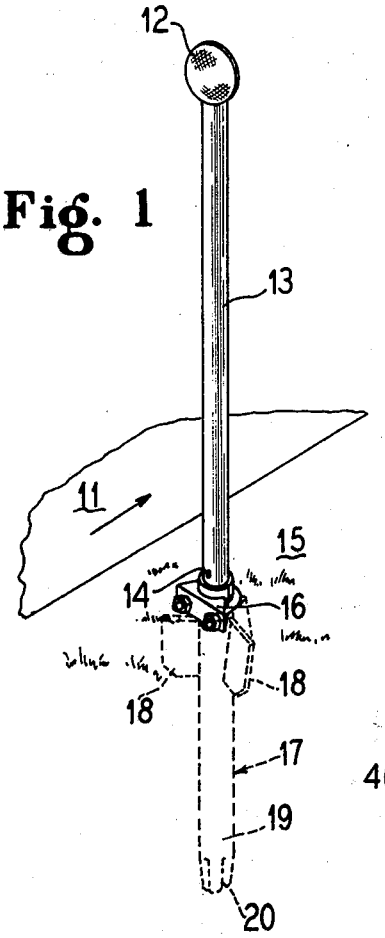
FIG. 1 is a perspective view of a highway delineator post anchored in the ground along a highway, by a torque fin anchor of this invention.
Figure 2:
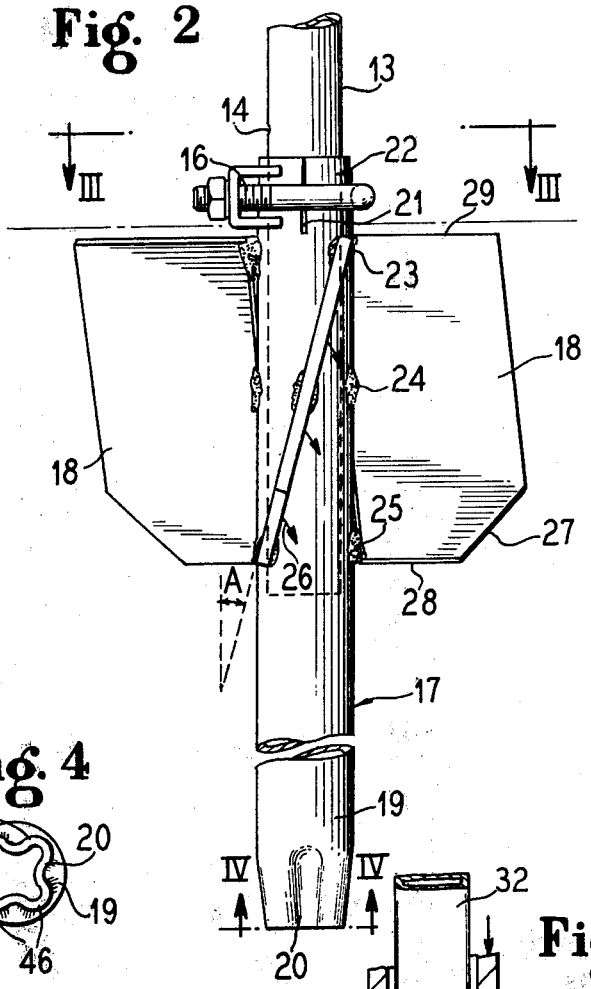
FIG. 2 is a broken, fragmentary side elevational view of the anchor of FIG. 1.
Figure 4:
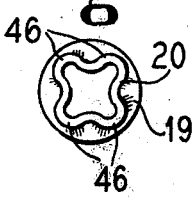
FIG. 4 is a bottom plan view of the driving end of the anchor of FIGS. 1 to 3 taken along the line IV—IV of FIG. 2.
Figure 3:
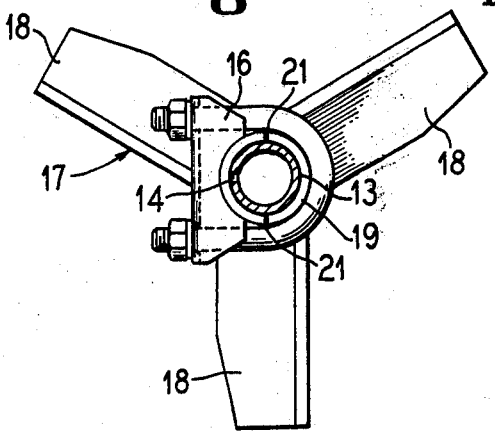
FIG. 3 is a transverse cross sectional view of the anchor of FIGS. 1 and 2 taken along the line III—III of FIG. 2.
Figure 5:
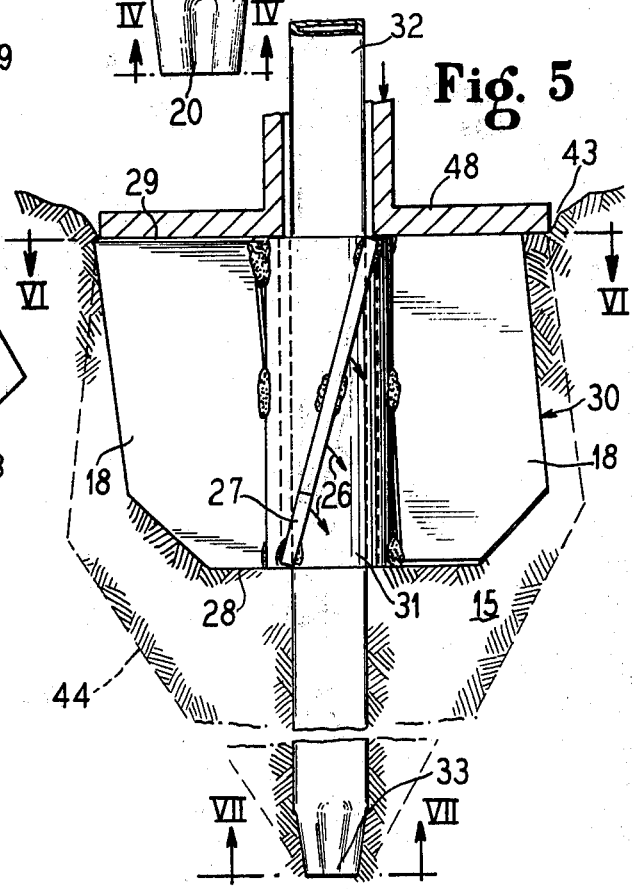
FIG. 5 is a broken, fragmentary, side elevational view, with parts in cross section, illustrating the driving of a torque fin anchor of this invention into the ground around a post.

In the drawings a first embodiment of the torque fin anchors of this invention is illustrated at 17 in FIGS. 1 to 3, a second embodiment is illustrated at 30 in FIGS. 5 to 7, and a third embodiment 45 is illustrated in FIGS. 8 to 10. In all of the illustrated embodiments three rectangularly shaped fins 18 radiate from a central pile which can be a long tube 19 or a short tube 31. Each fin is inclined relative to the axis of the pile at an angle A which is preferably 15° although this angle may vary considerably from, say 10° to say 30° and the number of fins may vary considerably from, say two to six. The inclination of the fins may be forwardly in a clockwise direction or rearwardly in a counter-clockwise direction.

Each fin 18 is secured to the central tube 19 or 31 by weld bonds 23, 24 and 25, at the trailing edge 29, at the mid point of the fin, and at the leading edge 28 of the fin although other modes of attaching the fin to the central pile member can be used.

Each fin 18 has a cut 27 extending diagonally inward from the outer edge of the fin to the leading edge 28 at an angle of preferably about 45° thereby reducing the radial length of the leading edge 28 to facilitate driving of the anchor into the ground and also to assist in attaining an equilibrium position when the anchor is rotated to its retension position as a cable anchor.

The sizes of the fins 18 and the length of the tubes 19 or 31 are proportioned to load requirements both in thickness and in linear size. Typical fin lengths for a post anchor and for a cable anchor are about 6 inches but this length may vary from say 4 inches to say 12 inches depending upon the usage intended.

In the FIGS. 1 to 4 embodiment, the post anchor 17 has a relatively long central tube 19 with the three fins 18 mounted near the top end of the tube as described above and with a neck portion 22 extending above the rear or top edges 29 of the fins. This neck portion has diametrically opposite axial slots 21 permitting contraction of the neck around a cylindrical post 13 fitted into the tube 19, by means of a U-bolt clamp 16. The lower end of the tube 19 is crimped to provide a reinforcement 20. This reinforcement has four loops or bends 46 providing a converging drill point with the lengths of the bends 46 extending to the full diameter of the tube 19 and equivalent to approximately the diameter of the tube. This reinforcement prevents collapsing or mushrooming of the end of the tube when it is driven into hard ground and also facilitates entry of the tube into the ground. With this reinforcement arrangement, the tube is adapted to be driven into paving material such as asphalt.

As shown in FIG. 1 the cylindrical post 13 has a reflector or other indicator 12 mounted on the top thereof and is positioned alongside of a highway 11 in the earth or ground shoulder 15 alongside of the highway path.

As also shown in FIGS. 1 to 3 the post 13 has a small diameter hole 14 punched therethrough in the direction of the oncoming traffic of the highway 11 at a level just above the neck 22. This hole weakens the post so that when it is struck by an automobile, the post will shear off at about the level of the hole. A fly-away break will not result but the post will bend parallel with the ground or if it does break away it will not fly into the air to cause a hazard. Then, as described above, the clamp 16 can be loosened, the portion of the post projecting into the tube 19 can be removed, and the broken end of the post can be inserted in the tube and the clamp tightened to again anchor the post in an upright position. A new hole 14 can be punched into the broken post immediately adjacent the neck 22 to accommodate a break away of the shortened post. Obviously, of course, a new post could be inserted in the anchor.

As illustrated in FIG. 1 the anchor 17 is driven into the ground to a depth so that only the neck 22 is above ground level and then the post 18 is dropped into the tube 19 to a depth for positioning the reflector or top mounting 12 at the desired height above the ground.

As the post anchor 17 is driven into the ground it may rotates slightly as the fins engage the ground and the fin angles should be such as to minimize restriction of the entry into the ground while at the same time providing ground confronting faces of large area to prevent not only lateral shifting or tilting of the anchor but also to confront overlying earth for preventing the anchor from being pulled upwardly. The anchor fins also compact the adjacent earth as they are driven underground. Firm imbedding of the anchor in the ground is developed.

While the post 13 has been illustrated as cylindrical in cross section it can have any desired cross section such as square, rectangular, T-shaped, or the like.

The length of the tube portion 19 of the anchor 17 will vary depending upon its use application and will increase in length for longer posts 13.

In the embodiment 30 of FIGS. 5 to 7 the central pile is in the form of a short tube 31 having a length approximately equal to that of the fins 18 and a thickness which can be less than the thickness of the tube 19 in the embodiment 17 because the driving depth is typically only a few inches below the surface of the ground 15.

As illustrated a square post 32 which can be used to support a sign, a fence, or any other structure is first driven into the ground to an adequate depth for sustaining it in an upright position. The leading edge of the post is preferably crimped to form a driving point reinforcement 33. The post anchor 30 is then dropped over the upright post 32 until it rests on the ground 15 whereupon a circular plate impactor, having a hollow neck freely embracing the post is activated to press the anchor into the ground below the surface to a depth of about 1 to 4 inches with reference to the rear edges 29 of the fins 18. As the post enters the ground, the fins, together with the circular plate impactor 48 will compact the ground to form a conical shaped compression 44 of the earth resulting not only from the compaction of the top level of the ground at 43 by the impactor but also because of the inclined angle of the fins 18 which develop a plough share action or ground compression force 26 on the back or lower sides of the fins.

The angle mounting of the fins serves an additional function reinforcing the tube 31 against bending because if the fins were parallel to the tube axis, tipping movements created by transverse forces on the post 32 could cause the fins to bend or break the mounting welds. By angling the fins, the ground forces are no longer perpendicular to the fins and components of the forces are lessened.

It will be understood that the short tube 31 of the anchor 30 could also receive a cylindrical post in snug engagement therewith.

The cable anchor 45 illustrated in FIGS. 8 to 10 is similar to the anchor 30 but has a hole 39 formed in one of the fins 18 close to the outer edge 40 of the fin and at a level in the rear portion of the fin toward the rear edge 29. A cable 35 is anchored in this hole 39.

As shown in FIG. 8 a drive rod or tamper 37 fits snugly in the anchor tube 31 and has a collar 38 near the leading end thereof engaging the top edges 29 of the fins 18. The driver 37 forces the anchor 45 into the ground to the desired level and, of course, forms a hole 41 of the diameter of the tube 31 as it advances the anchor into the ground. When the anchor is at the desired depth, as related to the soil density and the tension load which it is to support, the hole 41 is filled at 42 as shown in FIG. 9 and then the cable is pulled causing the anchor to tilt from the upright position of FIG. 8 to the inclined position of FIG. 9. This tilting is effected by the off-center cantilever action of the cable at the attachment hole 39 and an equilibrium position of an angle B from the horizontal is reached. This angle is usually about 15° from horizontal.

In the tilted or rotated position of FIG. 9, the planar faces of the fins will engage the earth above the anchor and tension loads on the cable 35 will develop a compression zone 36 of earth above the anchor. This compression zone 36 is generally conical diverging outwardly from the anchor to provide a large volume of earth that must be lifted before the anchor can be moved.

While the pile member 31 of the anchor 45 is illustrated in the form of a hollow tube it should be understood that it could be a solid rod and it should also be understood that the leading end of the tubular pile member 19 could be a solid rod.

From the above descriptions it will, therefore, be understood that this invention provides ground anchors composed of central pile members and inclined radiating fins which firmly anchor the pile members in the ground and which pile members can receive posts extending therefrom above the ground to support fences, signs or the like.

I claim as my invention:

1. A ground anchor adapted to anchor a cable or support a post which comprises a hollow central pile slidable over said post, a plurality of circumferentially spaced planar fins with tapered front portions radially secured along their length to said pile and inclined in the same direction relative to the longitudinal axis thereof at substantially the same clockwise angle with respect to the longitudinal axis, and said fins having large surface areas confronting and compacting the ground to resist shifting and retraction of the anchor under load and which cause said anchor to rotate slightly to minimize restriction of entry into the ground and a cable attachment hole through one of the fins near an outer longitudinal edge thereof and rearwardly of the longitudinal mid point of said fin.

2. A post anchor which comprises an elongated hollow tube having a driving means at one end and post engaging compression means at the other end, three circumferentially spaced planar fins radiating from said tube and connected along their entire length along a portion of the length of said tube and inclined in the same direction between 10 and 30 degrees relative to the longitudinal axis thereof at substantially the same clockwise angle with respect to the longitudinal axis, each of said fins having leading tapered edges converging toward the tube and a post having a bottom end portion telescoped in said tube and a main portion projecting above the tube in non-tiltable relation therewith and secured to said post anchor by said compression means.

3. A post anchor for a post embedded in ground, comprising a hollow tube open at both ends and slidably received over said post and embedded in the ground around said post, a plurality of circumferentially and approximately equal spaced planar fins connected to said tube along their entire length and radiating from said tube along the length thereof and inclined in the same direction between 10 and 30 degrees relative to the longitudinal axis thereof at substantially the same clockwise angle with respect to the longitudinal axis, each of said fins having leading, converging tapered edges toward the tube.

* * * * *